US006866262B2

(12) United States Patent
Gronau et al.

(10) Patent No.: US 6,866,262 B2
(45) Date of Patent: Mar. 15, 2005

(54) POSITIONING DEVICE FOR A GRIPPER CARRIAGE OF A SHEET-PROCESSING PUNCHING AND EMBOSSING MACHINE

(75) Inventors: Dieter Gronau, Meerbusch (DE); Gerhard Klaassen, Mönchengladbach (DE); Hermann Namowitz, Brüggen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 75 days.

(21) Appl. No.: 10/457,861

(22) Filed: Jun. 10, 2003

(65) Prior Publication Data

US 2003/0227128 A1 Dec. 11, 2003

(30) Foreign Application Priority Data

Jun. 10, 2002 (DE) ..... 102 25 647

(51) Int. Cl.[7] ..... B65H 7/02
(52) U.S. Cl. ..... 271/228; 198/803.7
(58) Field of Search ..... 271/228; 198/803.7

(56) References Cited

U.S. PATENT DOCUMENTS 3,809,390 A 5/1974 Lenoir
4,470,593 A 9/1984 Halff et al.
5,085,143 A * 2/1992 Becker ..... 101/183
2003/0079591 A1 5/2003 Cote et al.

FOREIGN PATENT DOCUMENTS

DE 30 44 084 A1 9/1982
DE 36 22 693 A1 * 1/1988 ..... B65H/1/04
GB 808816 2/1959
JP 06155634 A 6/1994

* cited by examiner

*Primary Examiner*—Donald P. Wals
*Assistant Examiner*—Kenneth W Bower
(74) *Attorney, Agent, or Firm*—Laurence A. Greenberg; Werner H. Stemer; Gregory L. Mayback

(57) ABSTRACT

A sheet punching and embossing machine has a gripper carriage and a positioning device for the gripper carriage. The gripper carriage has grippers for clamping sheets, being fixed with limited springing to a transport chain and, by the transport chain, being movable intermittently between the processing stations. The machine further has at least one stop face on its leading side in the running direction. The positioning device contains at least one stop that can be pivoted into the movement path of the gripper carriage and is fixed to a driven pivoting shaft. A pivoting drive of the stop used being at least one electrically operated, controllable servomotor, which is connected directly to the pivoting shaft.

5 Claims, 1 Drawing Sheet

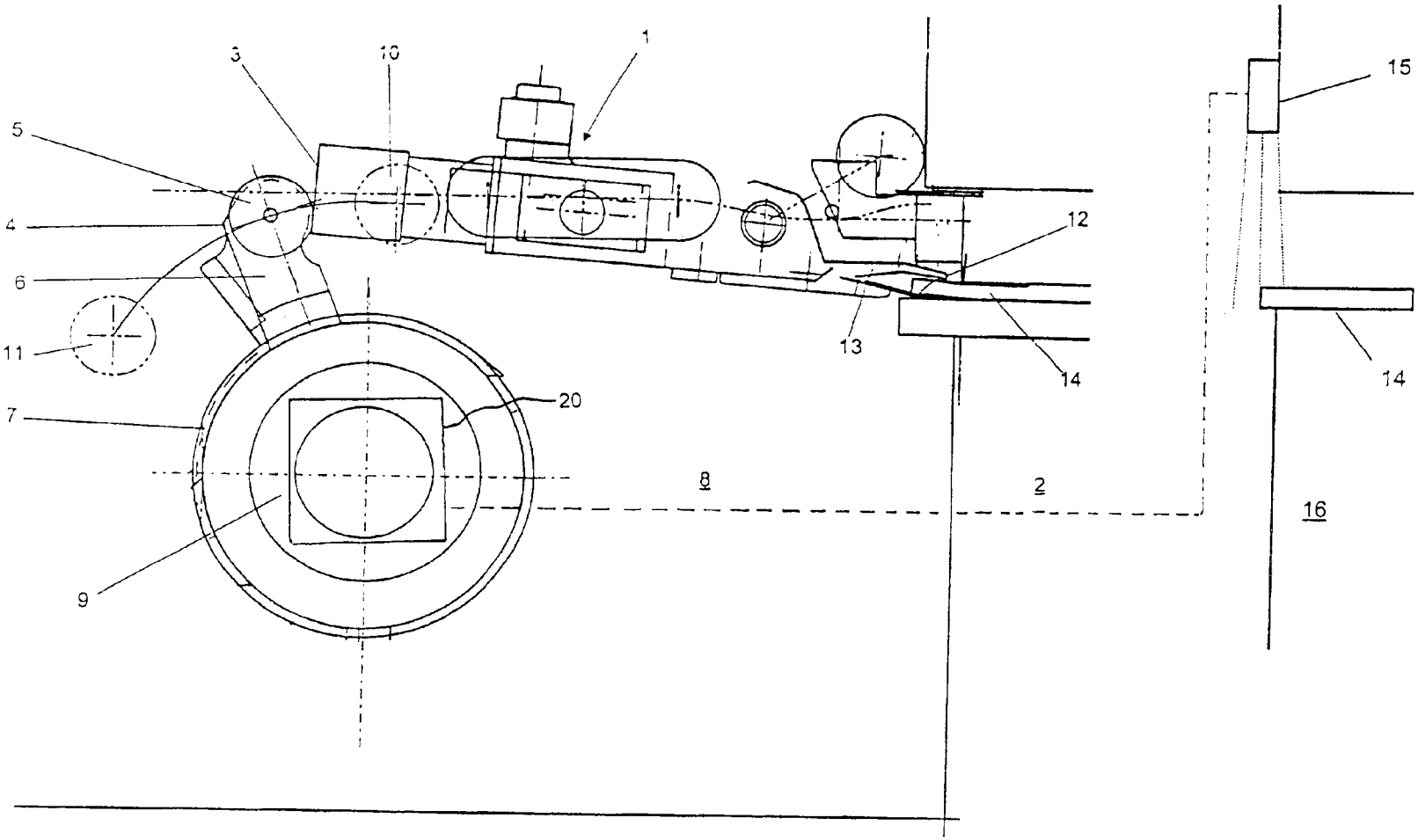
15
14
16
12
14
2
13
8
1
20
10
3
5
4
6
11
7
9

POSITIONING DEVICE FOR A GRIPPER CARRIAGE OF A SHEET-PROCESSING PUNCHING AND EMBOSSING MACHINE

BACKGROUND OF THE INVENTION

Field of the Invention

The invention relates to a sheet punching and embossing machine having a gripper carriage and a positioning device for the gripper carriages. The gripper carriage has grippers for clamping sheets, being fixed with limited springing to a transport chain and, by the transport chain, being movable intermittently between the processing stations. The machine has at least one stop face on its leading side in the running direction, and the positioning device contains at least one stop which can be pivoted into a movement path of the gripper carriage and is fixed to a driven pivoting shaft.

Sheet punching and embossing machines of this type are used, as is known, in the production of packages in order to punch blanks out of paper, board or other packaging materials, from which blanks folding boxes or similar packages are subsequently produced.

The known sheet-processing machines have devices for supplying, separating, feeding, gripping, aligning, punching, embossing, breaking out the waste, and delivering the blanks.

In such a machine, the sheet material that, for example, is conveyed continuously, coming from a stack, is supplied cyclically to the grippers of the gripper carriage, so that the sheets can be clamped individually. In the process, the gripper carriages are moved intermittently between the processing stations by a transport chain.

In order to be able to process the sheets in the correct position in the stations, the gripper carriages have, on their leading side in the running direction, stop faces which can be moved against a stop mounted in the machine frame. The stop is mounted on a pivoting shaft and can be pivoted into the movement path of the gripper carriage. In this case, the pivoting shaft is driven by a further lever fixed to the pivoting shaft, and a linkage that is fixed thereto and connected in an articulated manner.

German Patent DE 30 44 084 C2, corresponding to U.S. Pat. No. 4,470,593, discloses a sheet punching and embossing machine having a gripper device in which the gripped sheets are transported intermittently from one processing station to the next by the gripper device. In this case, the gripper carriages have, on the leading side in the running direction, stop faces which are used for the accurate positioning of the running carriage in the movement direction at the individual stations during the operation to be carried out by the station (for example punching, embossing or breaking out), and in this case the positioning of the gripper carriage against the stop face is normally designated registering and the stop itself as a register.

The positioning is carried out in that a stop wheel, which is held rotatably on a pin, is placed against the stop face located on the left-hand and right-hand end of the running carriage. In this case, the stop wheel acts as a stop. The stop wheel is in turn held by a lever welded onto a hollow shaft. The hollow shaft is mounted within the processing station such that it can rotate about its axis. In this case, the hollow shaft is pivoted via a linkage construction that is fixed to the hollow shaft via a further lever. Thus, the lever with the stop wheel can be moved between a stop position and a second position pivoted out of the movement path of the gripper rod.

The stop roller is expediently disposed in such a way that it is located out as far as possible at the respective end of the gripper carriage, in order that the positioning accuracy is increased.

German Patent DE 30 44 084 C2 further discloses the fact that the gripper carriage is suspended on a chain link in each case such that it can rotate about an axis parallel to the gripper carriage counter to a spring force, and is guided by a roller on a guide path that is independent of the chain path. After the gripper carriage has struck the positioning device and the chain has been braked, the gripper carriage is pressed against the stop by a spring force and thus positioned. After the operation to be carried out in the station, the positioning device, that is to say the lever located on the hollow shaft, together with the stop wheel fixed to it, pivots out of the movement path of the gripper carriage, and the gripper carriage can be moved into the next processing station by the driven chain.

One problem in such positioning devices is that the precise driving of the positioning devices is associated with high mechanical complexity.

SUMMARY OF THE INVENTION

It is accordingly an object of the invention to provide a positioning device for a gripper carriage of a sheet-processing punching and embossing machine that overcomes the above-mentioned disadvantages of the prior art devices of this general type, which has a simplified mechanical complexity for positioning the gripper carriage in the processing station in such a way that reliable positioning can be achieved at increased cycle frequencies in the processing stations.

With the foregoing and other objects in view there is provided, in accordance with the invention, a sheet punching and embossing machine. The machine contains processing stations, a transport chain, and a gripper carriage having grippers for clamping sheets. The gripper carriage is fixed with limited springing to the transport chain and, by the transport chain, the gripper carriage is movable intermittently between the processing stations. The gripper carriage further has at least one stop face on a leading side in a running direction. A positioning device for the gripper carriage, is provided. The positioning device contains a pivoting shaft, at least one stop to be pivoted into a movement path of the gripper carriage and fixed to the pivoting shaft, and a pivoting drive being at least one electrically operated, controllable servomotor connected directly to the pivoting shaft.

The object is achieved in that the pivoting drive of the stop used is at least one electrically operated, controllable servomotor, which is connected directly to the pivoting shaft. This provides the advantage that it is possible to dispense with the mechanically complicated linkage drives normally used for adjusting and actuating the positioning device.

In addition to the costly production of a linkage drive, the joints can also swing out, in particular in relation to the impacts when the gripper carriage is braked, and thus cause inaccuracies related to the position of the stop. As a further advantage, an electric motor needs less expenditure on maintenance than a linkage equipped with joints.

A further advantage which results from the use of electrically operated, controllable motors is that the position of the stop can be corrected at any desired time when setting up the machine. In the case of mechanical drives, a stop position, once set, can be changed only by an adjustment of adjusting or setting screws, for which purpose covers normally have to be removed, which in turn entails a great deal of mechanical effort and expenditure on time. This is in contrast to setting the position of the stop by the electric drive, which can be changed at any time by the motor control system and without having to intervene in the mechanics of the machine.

The servomotor is preferably fixed directly to the positioning device. Depending on the motor size and dynamic forces that occur in relation to the gripper carriage, it is likewise possible to imagine integrating a gearbox in front of the servomotor, so that an indirect connection between the motor and the stop is produced.

In accordance with an added feature of the invention, the stop is mounted such that the stop can be pivoted counter to the running direction of the gripper carriage and beyond a stop position belonging to a respective one of the processing stations.

In accordance with a further feature of the invention, the electrically operated, controllable servomotor is one of a plurality of electrically operated, controllable servomotors, and the stop of the positioning device contains at least two separately mounted stops. Each of the separately mounted stops is driven by a separate one the electrically operated, controllable servomotors.

In accordance with another feature of the invention, the processing stations have sensors operating without contact to detect a position of the sheets, and the sensors communicate with the electrically operated, controllable servomotors.

Other features which are considered as characteristic for the invention are set forth in the appended claims.

Although the invention is illustrated and described herein as embodied in a positioning device for a gripper carriage of a sheet-processing punching and embossing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic, side-elevational view of a gripper carriage in a processing station of an automatic punching and embossing machine and an associated positioning device according to the invention.

DESCRIPTION OF THE PREFERRED EMBODIMENTS

Referring now to the single FIGURE of the drawing in detail, there is shown a preferred configuration variant of the invention. The side view shows a gripper carriage 1 and a processing station as a punching station 2, the gripper carriage 1 striking a positioning device 4 at its end 3 leading in a running direction. The positioning device 4 contains a rotatably mounted stop wheel 5, a lever 6 that carries the stop wheel 5 and a pivotable shaft 7, to which the lever 6 is fixed. The pivoting shaft 7 is in turn mounted in the side part of a machine frame 8. On the pivoting shaft 7 there is an adapter flange 9 for the fixing of a gearbox or the direct mounting of a motor 20. The servomotor 20 is preferably mounted directly on the shaft 7 that pivots the stop. Thus, as a result of the use of extremely few mechanical devices, pivoting of the positioning device 4 would be made possible.

The circles 10, 11 illustrated in dashed lines show positions 11 of the stop wheel 5 after being pivoted in the running direction of the gripper carriage 1, and the position 10 of the stop wheel 5 counter to the running direction of the gripper carriage 1.

If the pivoting range 10, 11 of the positioning device 4 is widened, so that it can be pivoted beyond the stop or reference position belonging to the processing station 2, then the positioning device 4 can simultaneously be assigned a braking function. For this purpose, the positioning device 4 moves beyond the actual stop position belonging to the processing station 2 and toward the gripper carriage 1. If the gripper carriage 1 then moves into the processing station 2, the gripper carriage 1 strikes the positioning device 4 before reaching the processing position. The gripper carriage 1 can then be braked by using the braking function of the servomotors 20.

From this, there results a substantial advantage of the invention, to the effect that the gripper carriage 1 does not impart any or only a minimum impulse to the positioning device 4. The mechanical energy of the gripper carriage 1 is absorbed by the drive of the positioning device 4. The natural oscillations of the gripper carriage 1 that normally occur when it strikes the positioning device 4 without being damped are suppressed. The natural oscillatory behavior of the gripper carriage 1 when it strikes the positioning device 4 normally leads to oscillation-induced inaccuracies in the processing of the sheets, since the sheets are conveyed onward continuously.

As a result of pivoting the positioning device 4 counter to the running direction of the gripper carriage 1, and braking the gripper carriage 1 by the electric drive 20, the oscillation can be minimized and the processing speed of sheets 14 in the processing stations 2 can be increased substantially.

At its leading ends, the gripper carriage 1 has at least one stop face 3, against which the positioning device 4 acts. The lever of the positioning device 4 is fixed directly to the pivoting shaft 7 and forms the pivoting arm for the stop wheel 5. In this case, the pivoting shaft 7 is configured to pass right through and is mounted in both sides of the machine frame 8. The gripper carriage 1 is preferably equipped at the lateral ends with the stop face 3 in each case and the positioning device 4 in each case, so that the pivoting shaft 7 moves two positioning devices 4 against two stop faces 3.

In a further configuration variant, the positioning devices 4 are mounted separately and equipped with separate, independent servomotors 20. While the machine is being set up, the option is therefore provided of aligning the gripper carriage 1 individually.

The gripper carriage 1 is likewise illustrated only schematically. At a trailing end 12 of the gripper carriage 1, in the running direction, gripper tongs 13 hold the sheet 14 in the processing station 2.

The sheets 14 are gripped by the gripper tongs 13 in a feed station 16. In order to determine the alignment of the sheet 14 in relation to the gripper carriage 1, a sensor 15 is disposed in the feed station 16. The sensor 15 is disposed above the sheet 14 and registers the position of the edge of the sheet 14. In a further configuration variant, the sensor 15 can also be disposed at another point and, for example, register a printed mark on the sheet 14.

The gripper carriage 1 is then accelerated and braked again in the following stations for the purpose of processing. Depending on the position of the sheet 14 in the gripper carriage 1, determined in the feed station, the respective positioning device 4 in the processing station can then be driven and positioned in accordance with the data determined. The sheet punching and embossing machine is thus in a position to compensate for inaccuracies which have been produced during the gripping of the sheet 14, by an appropriate alignment of the positioning device 4.

Before the gripper carriage 1 populated with the sheet 14 moves into the processing station 2, the positioning device 4 moves into the position 10. As the gripper carriage 1 moves into the processing station 2, the leading end 3 of the gripper carriage 1 then reaches the positioning device 4 at the position 10. In this case, the motor is in a braking function, so that the mechanical energy of the gripper carriage 1 is transmitted to the pivoting shaft 7 and therefore to the servomotor 20 via the leading end 3 of the gripper carriage 1 and the stop wheel 5 and the lever 6.

After the position belonging to the processing station 2 has been reached, the gripper carriage 1 comes to a standstill. The position of the positioning device 4 and of the gripper carriage 1 illustrated in the figure reproduces the state of the machine during the processing of the sheet.

If the sensor 15 has determined a deviation between the reference and actual coordinates of the sheet 14, then, by a control loop, into which the sensor 15 and the motor 20 for actuating the register 4 are integrated, the deviation is compensated for by correcting the position of the positioning device 4. In this case, correcting the position of the sheet deviating from the reference coordinates is possible both in and counter to the transport direction of the sheets 14, since the gripper carriage 1 is held in a spring-mounted manner against the stop 5 of the positioning device 4. The sensor 15 illustrated operates as an optoelectric device for detecting the edge of the sheet 14. However, any other desired non-contact sensor 15 (laser, optoelectronic device, CCD camera), for example for detecting the position of the printed mark, can also be used.

If errors are determined when comparing the reference and actual coordinates, the position of the sheets 14 can be realigned via the positioning devices 4. In this case, aligning the sheet 14 in the running direction of the sheet 14 and also rotation of the sheets 14 are possible. The separate mounting of the positioning devices 4 provides the option of positioning the sheet 14 in the correct position in the processing station 2 by forming the control loop containing sensor 15, control system and drive.

If the punching and embossing machine is provided with two separately mounted positioning devices 4, then each stop 5 can be pivoted independently both in and counter to the running direction.

In the case in which the sheet 14 has been registered as rotated by the gripper carriage 1, the option is therefore provided of aligning the sheet 14 in the processing station by the positioning devices 4. For this purpose, one positioning device 4 is aligned counter to the running direction and the other positioning device is aligned in the running direction. The sheet 14 can then be processed in an aligned manner.

Following the processing of the sheet 14, the positioning device 4 pivots into the position 11. The path of the gripper carriage is thus free and the sheet 14 is moved into the next processing station. The positioning device 4 then moves into the position 10 again, in order to brake the next gripper carriage 1.

We claim:

1. A sheet punching and embossing machine, comprising:

processing stations;

a transport chain;

a gripper carriage having grippers for clamping sheets, said gripper carriage fixed with limited springing to said transport chain and, by said transport chain, said gripper carriage being movable intermittently between said processing stations, said gripper carriage further having at least one stop face on a leading side in a running direction;

a positioning device for said gripper carriage, said positioning device containing a pivoting shaft, at least one stop to be pivoted into a movement path of said gripper carriage and fixed to said pivoting shaft, and a pivoting drive being at least one electrically operated, controllable servomotor connected directly to said pivoting shaft.

2. The machine according to claim 1, wherein said stop is mounted such that said stop can be pivoted counter to the running direction of said gripper carriage and beyond a stop position belonging to a respective one of said processing stations.

3. The machine according to claim 1, wherein:

said electrically operated, controllable servomotor is one of a plurality of electrically operated, controllable servomotors; and said stop of said positioning device contains at least two separately mounted stops, and each of said separately mounted stops is driven by a separate one said electrically operated, controllable servomotors.

4. The machine according to claim 3, wherein said processing stations have sensors operating without contact to detect a position of the sheets, and said sensors communicate with said electrically operated, controllable servomotors.

5. In a sheet punching and embossing machine containing processing stations, a transport chain, and a gripper carriage having grippers for clamping sheets, the gripper carriage fixed with limited springing to the transport chain and, by the transport chain, the gripper carriage being movable intermittently between the processing stations, the gripper carriage further having at least one stop face on a leading side in a running direction, a positioning device for positioning the gripper carriage, the positioning device comprising:

a pivoting shaft;

at least one stop to be pivoted into a movement path of said gripper carriage and fixed to said pivoting shaft; and a pivoting drive being at least one electrically operated, controllable servomotor connected directly to said pivoting shaft.

* * * * *